United States Patent [19]

Eber

[11] 4,081,971

[45] Apr. 4, 1978

[54] AIR COOLED CENTRIFUGAL REFRIGERATION MACHINE WITH PROVISION TO PREVENT EVAPORATOR FREEZING

[75] Inventor: David Henry Eber, La Crosse, Wis.

[73] Assignee: The Trane Company, La Crosse, Wis.

[21] Appl. No.: 724,185

[22] Filed: Sep. 17, 1976

[51] Int. Cl.[2] ..... F25B 41/04

[52] U.S. Cl. ..... 62/216; 62/511

[58] Field of Search ..... 62/216, 217, 204, 205, 62/511, 185; 165/105, DIG. 14; 137/DIG. 8

[56] References Cited

U.S. PATENT DOCUMENTS

| | | | |
|---|---|---|---|
| 1,515,648 | 11/1924 | Arnold | 137/DIG. 8 |
| 2,331,264 | 10/1943 | Carter | 62/511 |

*Primary Examiner*—William E. Wayner
*Assistant Examiner*—Robert Charvat
*Attorney, Agent, or Firm*—Carl M. Lewis

[57] ABSTRACT

An air cooled centrifugal refrigeration machine is shown having an automatic shut-off valve in the liquid line to prevent natural circulation of refrigerant at low outdoor ambient temperatures that otherwise would cause freezing of the water in the evaporator.

10 Claims, 2 Drawing Figures

AIR COOLED CENTRIFUGAL REFRIGERATION MACHINE WITH PROVISION TO PREVENT EVAPORATOR FREEZING

BACKGROUND OF THE INVENTION

This invention relates to compression cycle refrigeration machines, particularly of the type having an air cooled condenser. if the compressor is of the type which will allow refrigerant gas to flow from the evaporator to the condenser during periods when the compressor is not operating, it is possible that the water in the evaporator may become frozen should the condenser be exposed to ambient temperatures below the freeze point. This can happen when the condenser is arranged at a higher elevation than the evaporator. Refrigerant vapor will migrate through or around the compressor to the condenser where it is condensed to a liquid. The liquid refrigerant then may flow by gravitational forces to the evaporator. This liquid refrigerant in the evaporator will then be evaporated causing a cooling effect. Should the refrigeration machine be shut down such that the water in the evaporator is not being circulated, this cooling effect can be sufficient to freeze the water within the tubes of the evaporator. It is to this problem that this instant invention is directed.

Prior hereto, it was the customary practice of the Assignee of this invention to place an expensive solenoid shutoff valve in the liquid line extending from the condenser to the liquid line throttling means. The solenoid was energized simultaneously with the compressor so as to open the liquid line at times when the compressor was operating and to close the liquid line at times when the compressor was not operating. This then had the effect of preventing the natural circulation of refrigerant which could cause freezing of the evaporator tubes under low temperature outdoor ambient conditions. The solenoid valve used for this purpose was of the pilot-operated type which utilized only those pressures immediately upstream and downstream of the valve to power the valve toward the open and closed positions.

The same refrigeration machine also included manual shutoff valves in the liquid line as well as in the gas line extending from the compressor to the condenser. These valves could be manually closed to facilitate servicing the condenser or the compressor and evaporator. These valves are a significant cost in the refrigeration machine. One of the objects of this invention therefore is to reduce such costs by combining one of these manual shutoff valves with the automatic operated valve.

Another objective of this invention is to provide a liquid line valve which is actuated and operated entirely by variations in the refrigerant pressures within the refrigeration machine.

This invention relates to a refrigeration system comprising an evaporator, compressor, condenser, and refrigerant liquid throttling means connected respectively in a closed refrigerant loop; valve means disposed in said loop between the outlet of said condenser and the inlet of said evaporator; valve operator means for operating said valve; and a vent line extending from said valve operator means to the inlet of said compressor; and vent line being disposed to bypass said evaporator.

More specifically this invention relates to a refrigeration system comprising: a closed refrigerant loop including; a shell and tube refrigerant evaporator having tubes for conducting a freezable heat transfer fluid, a centrifugal compressor connected to withdraw and compress refrigerant vapor from the shell side of said refrigerant evaporator, an air cooled refrigerant condenser subjectable to temperatures below the freeze point of said freezable fluid and connected to receive compressed refrigerant from said compressor, and a refrigerant liquid line connected to the outlet of said air cooled condenser and the shell side of said evaporator for conducting condensed refrigerant liquid from said condenser to said evaporator; said condenser being at an elevation sufficiently above said evaporator to allow refrigerant liquid to flow through said liquid line by force of gravity from said condenser to said evaporator; a refrigerant throttling means disposed in said liquid line; a valve disposed in said liquid line for interrupting said gravitational flow of liquid refrigerant to thereby prevent freezing of the tubes of said evaporator by natural migration of the refrigerant when said air cooled condenser is of a temperature at or below the freeze point of said freezable fluid in the tubes of said evaporator; first valve control means for yieldably biasing said valve to a closed position during a period when the compressor is not operating; and second valve control means for operating said valve in response to a change in refrigerant fluid pressure within said closed refrigerant loop resulting from operation of said compressor.

DESCRIPTION OF THE DRAWINGS

These and other objectives of the invention will become more evident as this specification proceeds to describe the invention with reference to the drawings in which.

DETAILED DESCRIPTION

Figure 2:
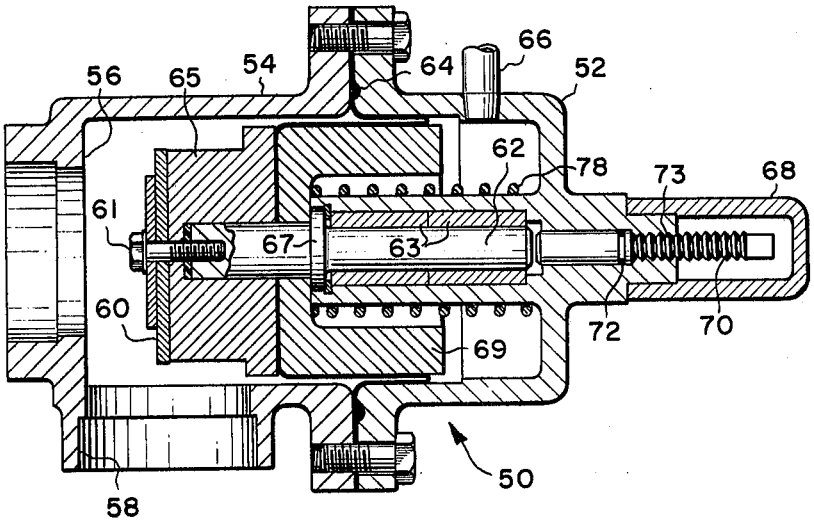
FIG. 2 is a detailed sectional view of the valve and valve operators of one embodiment of the invention.
Figure 1:
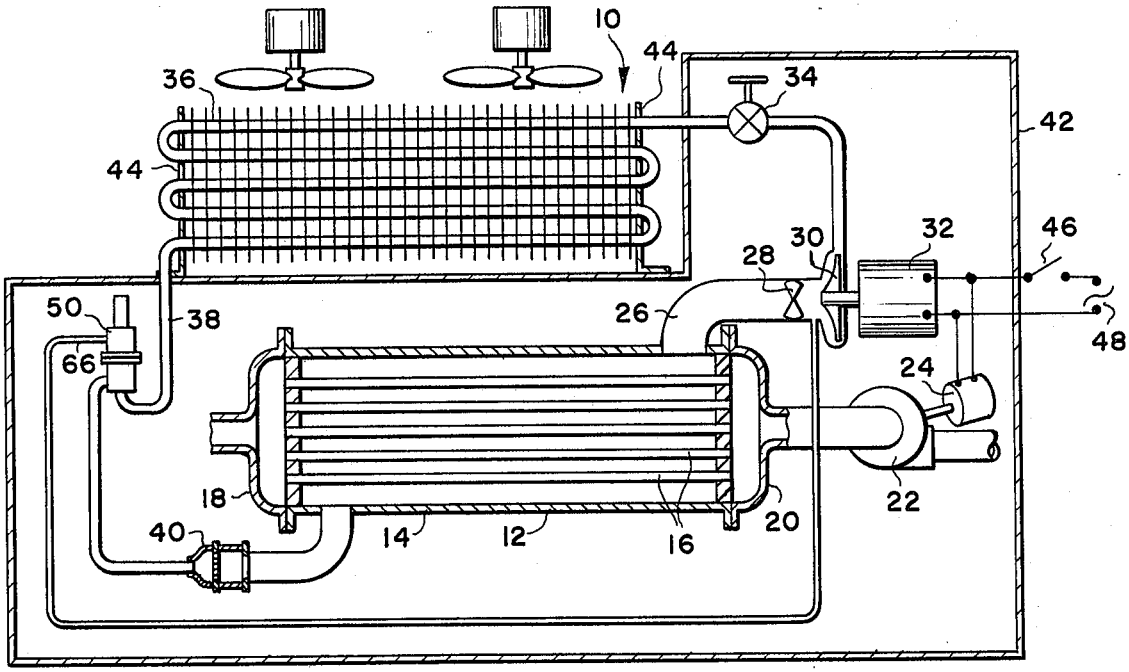
FIG. 1 is a semi-schematic vertical section of the refrigeration machine incorporating the invention.

Now with reference to the drawings, it will be seen that the refrigeration machine 10 includes a shell and tube type refrigerant evaporator 12 comprised of a shell 14 through which a plurality of tubes 16 extend between appropriate headers 18 and 20. Water to be chilled is conducted through the evaporator by pump 22 driven by motor 24.

Refrigerant within the shell 14 is evaporated and passes by way of suction line 26 passed inlet control vanes 28 to centrifugal compressor 30 driven by motor 32. Compressed refrigerant passes through the compressor discharge line to manual shutoff valve 34 to the air cooled condenser 36 where the compressed refrigerant vapor is condensed. The refrigerant liquid condensate passes from condenser 36 through a liquid line 38 back to the shell side of evaporator 12. The rate of flow of refrigerant during operation of the refrigeration machine is controlled by a liquid refrigerant throttling means 40 which may be comprised of two or more orifice plates or in the alternative a conventional float valve (not shown).

The evaporator 12 and compressor 30 are contained within a housing 42 which is normally maintained above freezing temperatures. The condenser is supported by support members 44 at an elevation above the evaporator 12 whereby refrigerant within condenser 36 may flow by force of gravity through liquid line 38 to evaporator 12.

Refrigerant may flow in this direction even when the compressor motor 32 and pump motor 24 are de-energized as by the opening of switch 46 connected in series with a power source 48. Should the outdoor ambient temperature be below the freeze point of water, refrigerant vapor in the evaporator will migrate through the centrifugal compressor 30 to the condenser where in turn it will condense and flow by gravity through liquid line 38 back to the evaporator to be vaporized again thereby causing a continuous cooling effect upon the water within the tubes 16. Since the water in tubes 16 is not flowing because pump motor 24 is not energized, the tubes will eventually become frozen.

This problem is obviated by the instant invention which employs an automatic liquid line shutoff valve assembly 50, the details of which are shown in FIG. 2.

Now referring to FIG. 2, it will be seen that valve assembly 50 includes an upper valve body 52 connected to a lower valve body 54. The lower valve body has a valve seat 56 disposed at the valve assembly inlet which is connected to the condenser. Lower valve body 54 also has an outlet opening 40. A valve or valve member 60 is arranged to cooperate with valve seat 56. Valve 60 is connected by bolt 61 to valve stem 62 which is mounted for axial movement in bearings 63. A rollable diaphragm or flexible boot 64 having a partial cylindrical configuration doubled over itself is sandwiched between spacer number 65 and cup-shaped member 69 on valve stem 62. These members are clamped by bolt 61 between valve 60 and collar 67 of valve stem 62. The valve 60 is yieldably maintained in a closed position through the bias of valve spring 78. In order that the valve may be automatically moved to the open position as shown, diaphragm 64 sealingly divides the valve housing into upper and lower chambers. A vent line 66 communicates the interior of the upper chamber with the refrigeration circuit at a point intermediate the inlet vanes 28 and compressor 30. When switch 46 is closed and compressor motor 32 energized, the pressure on the upper side of member 69, that is the pressure within the upper chamber, will rapidly decrease to thereby allow the pressure on the condenser side of valve 60 to bias the valve in a direction against the bias of valve spring 78 to open the valve as shown. Should the compressor be de-energized, the pressure differentials within the refrigeration system loop will become equalized and valve 60 will once again close under the bias of spring 78.

Should it be desirable to isolate the condenser from the remainder of the refrigeration system loop, such as, for example, for purposes of servicing, manual valve 34 in the compressed gas line may be closed. The outlet of condenser 36 is closed by removal of a seal cap 68 covering the end of stem 70 which is mounted on the upper valve body 52 and provided with a stem seal 72. The stem 70 is provided with a threaded portion 73 cooperatively associated with the upper valve body 52. By manually rotating stem 70, it is caused to move toward the valve stem 62 thereby forcing valve 60 against seat 56. The valve assembly 50 will then remain closed despite what pressures may exist in the upper and lower valve bodies.

When it is desired to return valve assembly to automatic control it is merely necessary to rotate the stem 70 in the opposite direction thereby freeing it from the valve stem 62 and replacing the seal cap 68. Thus it will be seen that valve assembly 50 serves both as an automatic and manual shutoff valve assembly. Furthermore, it will be seen that valve assembly 50 provides automatic freeze protection for the evaporator by automatically preventing migration of refrigeration from the condenser to the evaporator during periods when the compressor is not in operation.

Although I have described in detail the preferred embodiment of my invention, I contemplate that many changes may be made without departing from the scope or spirit of my invention. Thus it may be desired to control the float valve, in a system using a conventional float valve throttling means, in accordance with my invention. I therefore desire to be limited only by the claims.

I claim:

1. A refrigerant system comprising an evaporator, compressor, condenser and refrigerant liquid throttling means connected respectively in a closed refrigerant loop; valve means disposed in said loop between the outlet of said condenser and the inlet of said evaporator; valve operator means for operating said valve; a vent line extending from said valve operator means to the inlet of said compressor; and vent line being disposed to bypass said evaporator; and a controllable gas throttling means disposed between said evaporator and said compressor, said vent line connecting to said loop between said gas throttling means and said compressor.

2. A refrigeration system comprising: a closed refrigerant loop including; a shell and tube refrigerant evaporator having tubes for conducting a freezable heat transfer fluid, a centrifugal compressor connected to withdraw and compress refrigerant vapor from the shell side of said refrigerant evaporator, an air cooled refrigerant condenser subjectable to temperatures below the freeze point of said freezable fluid and connected to receive compressed refrigerant from said compressor, and a refrigerant liquid line connected to the outlet of said air cooled condenser and the shell side of said evaporator for conducting condensed refrigerant liquid from said condenser to said evaporator; said condenser being at an elevation sufficiently above said evaporator to allow refrigerant liquid to flow through said liquid line by force of gravity from said condenser to said evaporator; a refrigerant throttling means disposed in said liquid line; means other than said liquid line for permitting the migration of refrigerant vapor from said evaporator to said condenser whereby said vapor may condense to a liquid; a shutoff valve disposed in said liquid line for interrupting said gravitational flow of liquid refrigerant to thereby prevent freezing of the tubes of said evaporator by natural migration of the refrigerant when said air cooled condenser is of a temperature at or below the freeze point of said freezable fluid in the tubes of said evaporator; first means for controlling said valve for yieldably biasing said valve to a closed position during a period when said compressor is not operating; and second means for controlling said valve overriding said first means for opening said valve in response to a change in refrigerant fluid pressure within said closed refrigerant loop resulting from operation of said compressor.

3. The apparatus as defined by claim 1 wherein said second means is subjected to suction side refrigerant fluid pressure during operation thereof.

4. The apparatus as defined by claim 3 including inlet control vanes in said compressor and wherein a portion of said second means subjected to suction side pressure is vented to a point downstream of the vanes of said compressor through a line which bypasses said throttling means, said evaporator and said vanes.

5. The apparatus as defined by claim 1 wherein said second means includes a flexible diaphragm to which one side thereof is applied the refrigerant fluid pressure.

6. The apparatus as defined by claim 5 wherein said diaphragm is a flexible boot having a portion of cylindrical configuration doubled over itself.

7. The apparatus as defined by claim 1 including a third valve control means comprising a hand operator for overriding said second means whereby said valve may be closed by hand and a valve disposed in said loop between the outlet of said compressor and the inlet of said condenser.

8. The apparatus as defined by claim 1 wherein the pressure on the condenser side of said valve biases said valve toward the open position.

9. The apparatus as defined by claim 1 wherein said valve is disposed between said condenser and said refrigerant throttling means.

10. The apparatus as defined by claim 1 wherein said first means includes a spring.

* * * * *

UNITED STATES PATENT AND TRADEMARK OFFICE

CERTIFICATE OF CORRECTION

PATENT NO. : 4,081,971

DATED : April 4, 1978

INVENTOR(S) : David Henry Eber

It is certified that error appears in the above-identified patent and that said Letters Patent are hereby corrected as shown below:

In Column 3, line 20 after the word "opening" insert the words --58 connected to the evaporator via liquid line throttling means --.

In Claim 1, line 8, delete the word "and" and insert in lieu thereof the word --said--.

In the first line of each of Claims 3, 5, 7, 8, 9 and 10 delete the numeral "1" and insert in lieu thereof the numeral --2--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*